US007530609B2

(12) United States Patent
Beauchamp et al.

(10) Patent No.: US 7,530,609 B2
(45) Date of Patent: May 12, 2009

(54) SELF-PRESENTING NON-EXCITABLE SECONDARY HOOD LATCH ASSEMBLY

(75) Inventors: Jason Allen Beauchamp, Pellston, MI (US); James Robert DePlonty, Bellaire, MI (US); Daniel Ethan Bies, Lake Orion, MI (US)

(73) Assignee: Dura Global Technologies, Inc., Rochester Hills, MI (US)

( * ) Notice: Subject to any disclaimer, the term of this patent is extended or adjusted under 35 U.S.C. 154(b) by 251 days.

(21) Appl. No.: 11/394,325

(22) Filed: Mar. 30, 2006

(65) Prior Publication Data

US 2007/0246952 A1 Oct. 25, 2007

(51) Int. Cl.
*E05C 3/06* (2006.01)
*E05C 3/00* (2006.01)

(52) U.S. Cl. ..... 292/214; 292/126; 292/216; 292/DIG. 14

(58) Field of Classification Search ..... 292/126, 292/216, 214, DIG. 14
See application file for complete search history.

(56) References Cited

U.S. PATENT DOCUMENTS

| | | | | | |
|---|---|---|---|---|---|
| 2,333,465 | A * | 11/1943 | Claud-Mantle | ..... | 292/1 |
| 2,333,466 | A * | 11/1943 | Claud-Mantle | ..... | 292/11 |
| 2,492,688 | A * | 12/1949 | Dall | ..... | 91/477 |
| 4,756,562 | A * | 7/1988 | Foster et al. | ..... | 292/28 |
| 5,000,493 | A * | 3/1991 | Bastien | ..... | 292/11 |
| 6,149,210 | A * | 11/2000 | Hunt et al. | ..... | 292/216 |
| 6,543,822 | B1 * | 4/2003 | King et al. | ..... | 292/214 |
| 6,666,483 | B2 * | 12/2003 | Baniak et al. | ..... | 292/123 |

* cited by examiner

*Primary Examiner*—Carlos Lugo
(74) *Attorney, Agent, or Firm*—Porter, Wright, Morris, Arthur, LLP; Richard M. Mescher; Dean B. Watson

(57) ABSTRACT

A secondary latch assembly includes a mounting bracket, a release hook, and a release handle operably connected to the release hook. The release handle is pivotable relative to the mounting bracket between a first position wherein the release handle is out of view, a second position wherein the release handle is presented and the release hook is engaging the striker, and a third position wherein the release handle is rotated from its second position and the release hook is released from the striker. A spring member biases the release handle towards the first position. The release hook is pivotable relative to the release handle between a locked position wherein the release hook is lockingly engageable with the striker and a released position wherein the release hook is out of locking engagement with the striker while the release handle remains in the first position.

17 Claims, 6 Drawing Sheets

SELF-PRESENTING NON-EXCITABLE SECONDARY HOOD LATCH ASSEMBLY

CROSS-REFERENCE TO RELATED APPLICATIONS

Not Applicable

STATEMENT REGARDING FEDERALLY SPONSORED RESEARCH

Not Applicable

REFERENCE TO MICROFICHE APPENDIX

Not Applicable

FIELD OF THE INVENTION

The present invention generally relates to a latch assembly and, more particularly, to a self-presenting secondary latch assembly for maintaining a closure element of a motor vehicle in a partially opened position.

BACKGROUND OF THE INVENTION

Hoods or closures of engine or storage compartments of motor vehicles are typically provided with a primary latch and a secondary or safety latch. Hoods on such motor vehicles are typically biased upward so that when the primary latch is released, the hood is latched by the secondary latch in a partially opened position when the secondary latch assembly engages a secondary striker. Releasing the secondary latch allows the hood to enter a fully opened position. Thus, release of the primary latch alone does not permit the hood to enter the fully opened position.

It is known to provide a handle under the hood for releasing the secondary latch to allow the hood to enter the fully opened position. The position of such handles varies from vehicle type to vehicle type but are typically out of view, and it is difficult for a person to anticipate the position of such a handle on a vehicle type the person is unfamiliar with. It is also known to have a secondary hood latch that has a release handle that is automatically presented out from underneath the hood and into view when the primary latch is released. Such self-presenting secondary latches are typically mounted on a stationary portion of the vehicle within the interior of the vehicle's engine area, thus taking up space within the engine area and increasing the time and cost of installation.

One proposed solution to the above problems is described in U.S. Pat. No. 4,756,562 to Foster et al., the disclosure of which is expressly incorporated herein in its entirety by reference. This secondary latch, however, is relatively complex, relatively expensive, and time consuming to manufacture and assemble.

Another proposed solution to the above problems is described in U.S. Pat. No. 6,543,822 to King et al., the disclosure of which is expressly incorporated herein in its entirety by reference. This self-presenting secondary latch is compact and mounted to the hood of the vehicle as a whole assembly so that installation is simplified and space is saved. Additionally, relatively few parts are used so manufacturing is relatively simple and production costs are relatively low. However, the presenter handle remains presented outside the hood when the hood is open and does not return until the hood is closed. This can result in damage to the release handle, the hood, and other components of the secondary latch. Accordingly, there is a need for an improved self-presenting secondary latch.

SUMMARY OF THE INVENTION

The present invention provides a self-presenting secondary latch assembly that overcomes at least some of the above-described problems of the related art. According to the present invention, A self-presenting secondary latch assembly comprises, in combination, a mounting bracket, a release hook supported by the mounting bracket, and a release handle supported by the mounting bracket and operably connected to the release hook. The release handle is pivotable relative to the mounting bracket between a first position wherein a grasping portion of the release handle is out of view, a second position wherein the grasping portion is presented in view and the release hook is engaging the striker, and a third position wherein the release handle is rotated from its second position and the release hook is released from the striker. A first spring member biases the release handle towards the first position. The release hook is pivotable relative to the release handle between a locked position wherein the release hook is lockingly engageable with the striker and a released position wherein the release hook is out of locking engagement with the striker while the release handle remains in the first position According to another aspect of the present invention, A self-presenting secondary latch assembly comprises, in combination, a mounting bracket, a release hook supported by the mounting bracket, and a release handle supported by the mounting bracket and operably connected to the release hook. The release handle is pivotable relative to the mounting bracket between a first position wherein a grasping portion of the release handle is out of view, a second position wherein the grasping portion is presented in view and the release hook is engaging the striker, and a third position wherein the release handle is rotated from its second position and the release hook is released from the striker. A first spring member biases the release handle towards the first position. The release hook is pivotable relative to the release handle between a locked position wherein the release hook is lockingly engageable with the striker and a released position wherein the release hook is out of locking engagement with the striker. The first spring member pivots the release handle from the third position to the first position when an operator releases the handle and the release hook is out of engagement with the striker.

According to yet another aspect of the present invention, a self-presenting secondary latch assembly comprises, in combination, a mounting bracket, a release hook supported by the mounting bracket, and a release handle supported by the mounting bracket and operably connected to the release hook. The release handle is pivotable relative to the mounting bracket between a first position wherein a grasping portion of the release handle is out of view, a second position wherein the grasping portion is presented in view and the release hook is engaging the striker, and a third position wherein the release handle is rotated from its second position and the release hook is released from the striker. A first spring member biases the release handle towards the first position. The release hook is pivotable relative to the release handle between a locked position wherein the release hook is lockingly engageable with the striker and a released position wherein the release hook is out of locking engagement with the striker while the release handle remains in the first position. A second spring member biases the release hook toward the locked position. The first spring member pivots the release handle from the third position to the first position when an operator releases the handle and the release hook is out of engagement with the striker.

From the foregoing disclosure and the following more detailed description of various preferred embodiments it will be apparent to those skilled in the art that the present invention provides a significant advance in the technology and art of secondary latch assemblies. Particularly significant in this regard is the potential the invention affords for providing a high quality, reliable, low cost assembly that is not excited upon closure. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1:
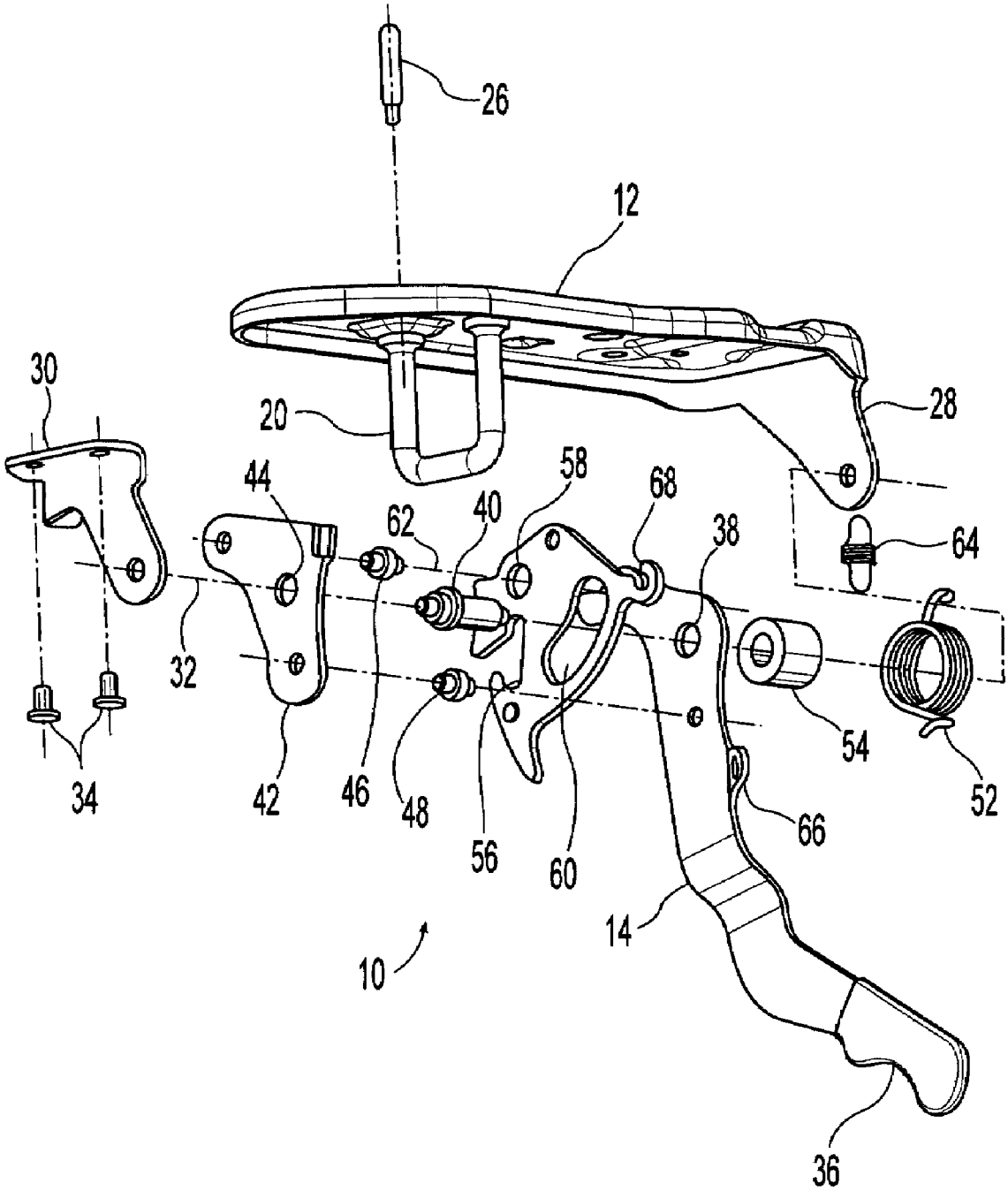
FIG. 1 is an exploded perspective view of a self-presenting secondary latch assembly according to a preferred embodiment of the present invention.
Figure 2:
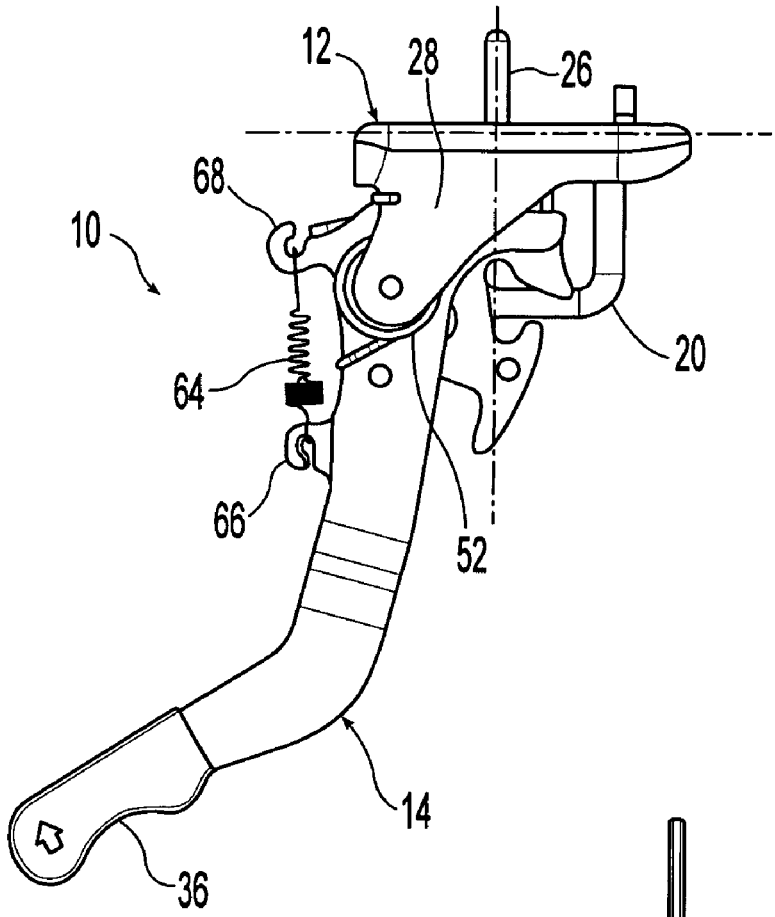
FIG. 2 left side elevational view of the secondary latch assembly of FIG. 1.
Figure 3:
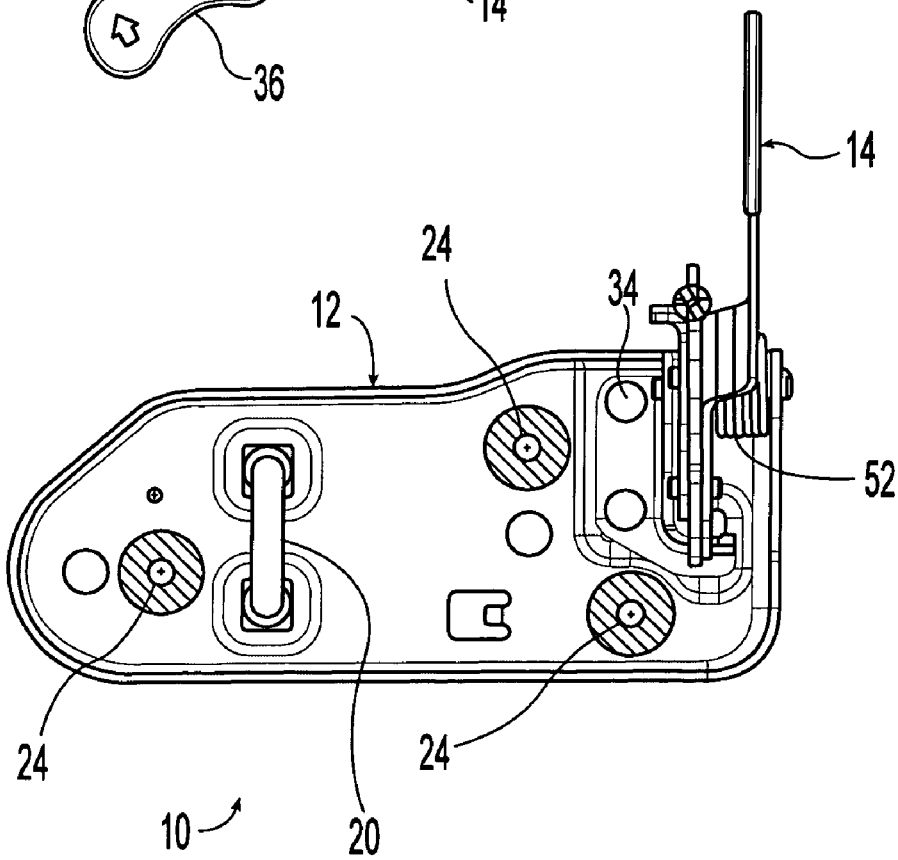
FIG. 3 is a bottom plan view of the secondary latch assembly of FIGS. 1 and 2.
Figure 4:
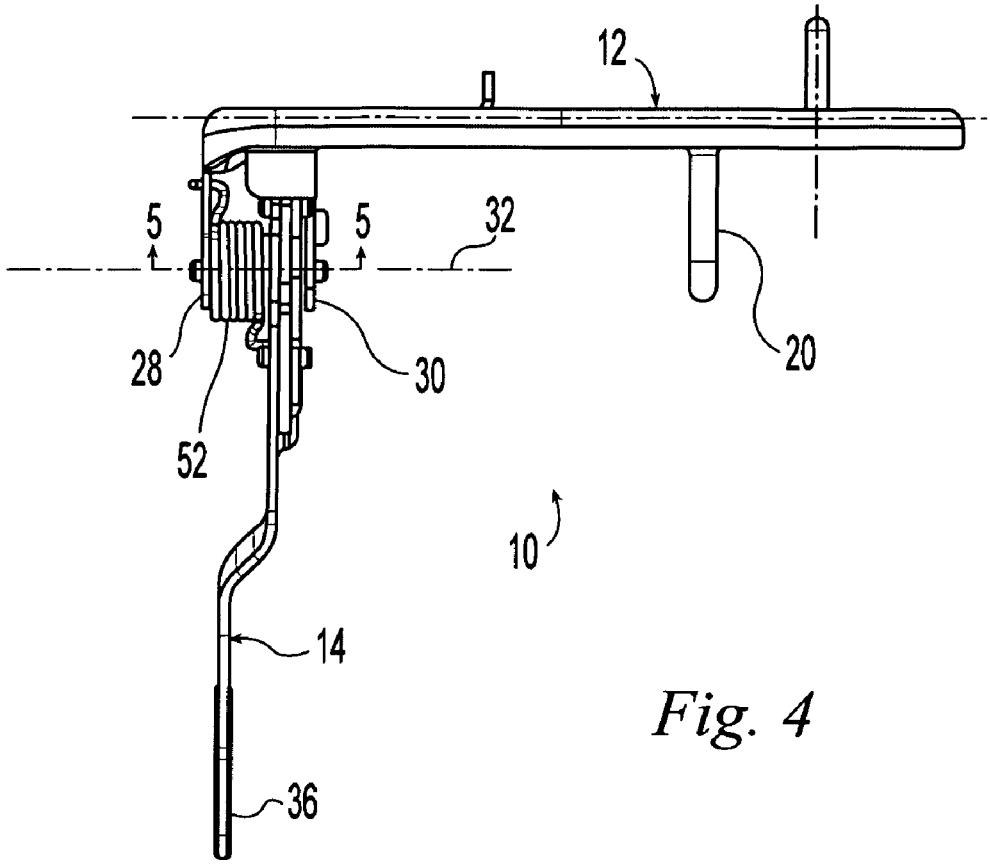
FIG. 4 is a rear elevational view of the secondary latch assembly of FIGS. 1 to 3.
Figure 5:
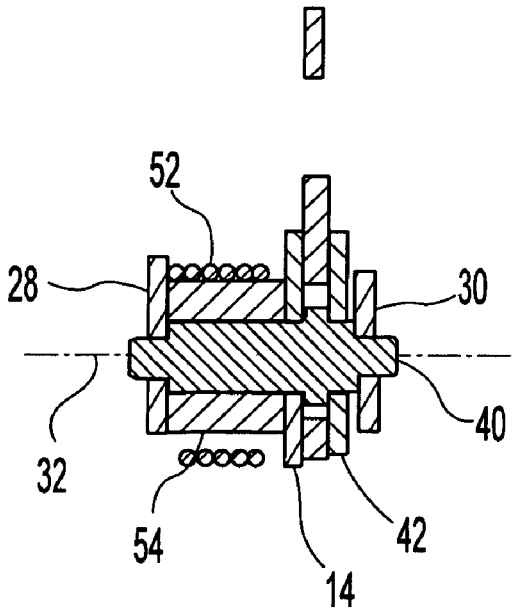
FIG. 5 is an enlarged cross-sectional view taken along line 5-5 of FIG. 4.

It should be understood that the appended drawings are not necessarily to scale, presenting a somewhat simplified representation of various preferred features illustrative of the basic principles of the invention. The specific design features of a secondary latch assembly as disclosed herein, including, for example, specific dimensions, orientations, locations, and selections of the various components, will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the system illustrated in the drawings. In general, up or upward generally refers to an upward direction within the plane of the paper in FIGS. 6 to 10 and down or downward generally refers to a downward direction within the plane of the paper in FIGS. 6 to 10. Also in general, fore or forward refers to a direction toward the front of the motor vehicle, that is, generally toward the left within the plane of the paper in FIGS. 6 to 10 and aft or rearward refers to a direction toward the rear of the motor vehicle, that is, generally toward the right within the plane of the paper in FIGS. 6 to 10.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved self-presenting secondary latch disclosed herein. The following detailed discussion of various alternative and preferred embodiments will illustrate the general principles of the invention with reference to a self-presenting secondary latch for a hood of a motor vehicle such as an automobile, sport utility vehicle (SUV), truck, or the like. Other embodiments suitable for other applications will be apparent to those skilled in the art given the benefit of this disclosure.

Referring now to the drawings, FIGS. 1 to 11 show a self-presenting secondary hood latch assembly 10 for a motor vehicle according to a preferred embodiment of the present invention. The illustrated embodiments of the present invention are particularly adapted for use with an automobile hood that is hinged for movement between a fully closed position and a fully opened position and is biased to move toward the fully opened position. In the preferred embodiments, the self-presenting secondary latch assembly 10 is adapted to maintain the hood in a partially opened position after a primary latch releases the hood from the fully closed position. It is noted that the present invention can be utilized with any apparatus or system having a panel portion hinged for movement with respect to an enclosure portion and having and a primary and secondary latch for opening the panel portion.

FIGS. 1 to 5 illustrate a self-presenting secondary latch assembly 10 that includes a mounting bracket 12, a release handle 14 movable relative to the mounting bracket 12, and a release hook 16 movable relative to the mounting bracket 12 and the release handle 14. The mounting bracket 12 secures the secondary latch assembly 10 to the underside of a hood 18 (best shown in FIGS. 6 to 11). The mounting bracket 12 preferably includes a primary striker 20 for use with a primary hood latch assembly for maintaining the hood 18 in a fully closed position. When the primary latch assembly releases the primary striker 20, the hood 18 is biased upward until the release hook 16 of the secondary latch assembly 10 engages a secondary striker 22 (best shown in FIGS. 6 to 11) to limit further upward movement of the hood 18 until an operator manually releases the release hook 16 from the secondary striker 22 as described in more detail hereinbelow.

The illustrated mounting bracket 12 is generally planar and is sized and arranged to be underside of the hood 18. The illustrated mounting bracket 12 is provided with a plurality of openings 24 for receiving mechanical fasteners for securing the mounting bracket 12 but any other suitable securing means can alternatively be utilized. The illustrated primary striker 20 downwardly extends from the mounting bracket 12. The primary striker 20 is sized and shaped to cooperate with the primary hood latch assembly. The illustrated mounting bracket 12 is also provided with a substantially vertical and upwardly extending locating pin for cooperating with an opening in the hood 18 to precisely locate the secondary latch assembly 10 relative to the hood 18 and the secondary striker 22. The mounting bracket 12 also includes downwardly extending first and second mounting portions or flanges 28, 30 that are substantially planar and laterally spaced apart. The flanges 28, 30 have coaxial openings that form a horizontal and laterally extending pivot axis 32 for the release handle 14 as described in more detail hereinbelow. The illustrated first flange 28 is unitary with the horizontal planar portion of the mounting bracket 12. The illustrated second flange 30 is a separate component that is secured to the horizontal planar portion of the mounting bracket 12 with mechanical fasteners 34 in the form of a pair of rivets. It is noted that the mounting bracket 12 can alternatively be constructed in any other suitable manner.

The illustrated release handle 14 is generally elongate having a grasping portion 36 at a first or free end and an opening 38 near a second end sized and shaped for receiving a primary pivot pin or axle 40 therein. The primary pivot pin 40 extends between the openings of the first and second flanges 28, 30 of the mounting bracket 12 to pivotably support the release handle 14. A cover plate 42 also has an opening 44 sized and shaped for receiving the primary pivot pin 40 and is spaced apart from the release handle 14 by a hub or enlarged diameter portion of the primary pivot pin 40 that forms opposed abutment surfaces engaged by the release handle 14 and the cover plate 42. The cover plate 42 is secured to the release handle 14 for rotation therewith about the pivot axis 32. The illustrated cover plate 42 is secured to and spaced apart from the release handle 14 by first and second pivot pins or rivets 46, 48. The illustrated pivot pins 46, 48 each have a hub or enlarged diameter portion that forms opposed abutment surfaces engaged by the release handle 14 and the cover plate 42.

Figure 9:
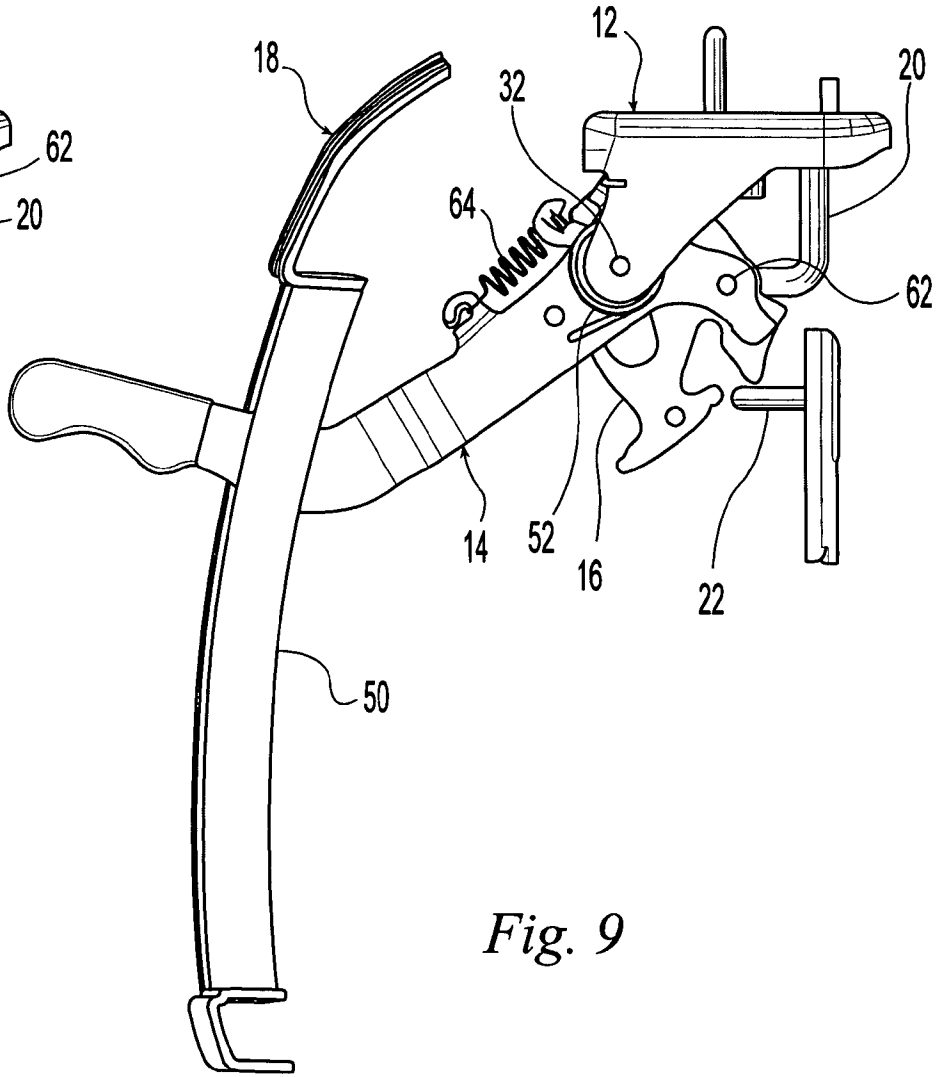
FIG. 9 is a left side elevational view similar to FIG. 8 but wherein the release handle has been manually raised to release the hook from the secondary striker.

Mounted in this manner, the release handle 14 is movable about the pivot axis 32 between a first or locked position wherein the release handle 14 is retracted entirely beneath the hood 18 (best shown in FIGS. 2 and 6), a second or presented position wherein the grasping portion 36 of the release handle 14 is presented to a user through a grille 50 of the hood 18 when the hood 18 is held in a partially opened position by the secondary latch assembly 10 (best shown in FIG. 8), and a third or released position wherein the release handle 14 causes the release hook 16 to move to its released position allowing the hood 18 to be fully opened (best shown in FIG. 9). When the illustrated release handle 14 is in its closed or locked position, the release handle 14 is retracted within the enclosure portion of the vehicle. When the illustrated release handle 14 is in its presented position, grasping portion 36 of the release handle 14 extends out from beneath the hood 18 so that the grasping portion of the release handle 14 is visible to a user in front of the hood 18. Although the illustrated release handle 14 is illustrated as supported by the mounting bracket 12, it is noted that the release handle 14 may be remotely positioned from the mounting bracket 12. It is also noted that the present invention may be used without a mounting bracket 12 by mounting the other components of the secondary latch assembly 10 directly to a structure such as the hood 18.

A first biasing means or spring member 52 is provided for resiliently biasing the release handle 14 to its first or locked position. The illustrated first spring member 52 is a torsion spring but any other suitable type of biasing means can alternatively be utilized. The illustrated first spring member 52 is positioned on a spacer 54 located about the primary pivot pin 40. The illustrated spacer 54 extends between the release handle 14 and the first flange 28 of the mounting bracket 12. A first end of the first spring member 52 engages an edge of the first flange 28 and a second end of the first spring member 52 engages an edge of the release handle 14. The first spring member 52 thus biases the release handle 14 about the pivot axis 32 in a direction toward its locked position (a counter-clockwise direction in FIGS. 2 and 6) wherein an upper end of the release handle 14 contacts a stop.

The illustrated release hook 16 is positioned between the release handle 14 and the cover plate 42 and has a hooking portion 56 sized and shaped for cooperating with the secondary striker 22 to releasably secure the secondary latch assembly 10 thereto as described in more detail hereinafter. The illustrated release hook 16 is provided with an opening 58 sized and shaped for receiving the first pivot pin 46 therein so that the release hook 16 is pivotable relative to the release handle 14. The illustrated release hook 16 is also provided with a slot 60 sized and shaped for receiving the primary pivot pin 40 therein and is spaced a distance from the pivot axis 62 about which the release hook 16 is pivotally mounted to the release handle 14. The slot 60 is preferably arcuate in shape, but any other suitable shape can alternatively be utilized.

Mounted in this manner, the release hook 16 is movable relative to the release handle 14 about the secondary pivot axis 62 between a first or locked position wherein the release hook 16 will engage secondary striker 22 when the hood 18 is in a partially opened position (best shown in FIGS. 2 and 6) and a second or closing position wherein the release hook 16 can resiliently pass the secondary striker 22 as the hood 18 is closed without moving, that is, "exiciting" the release handle 14. When the release hook 16 is in its locked position, the primary pivot pin 40 is at the end of the slot 60 such that the release hook 16 moves with the release handle 14 about the primary pivot axis 32, when the release handle 14 is moved between the first or locked position wherein the release hook 16 will engage secondary striker 22 when the hood 18 is in a partially opened position (best shown in FIGS. 2 and 6) and a third or released position wherein the release hook 16 allows the hood 18 to be fully opened (best shown in FIG. 9).

A second biasing means or spring member 64 is provided for biasing the release hook 16 in a direction toward its locked position. The illustrated second spring member 64 is a coil tension spring but any other suitable type of biasing means can alternatively be utilized. The illustrated second spring member 64 extends between the release handle 14 and the release hook 16. A first end or loop of the second spring member 64 engages a hook 66 of the release handle 14 and a second end or loop of the second spring member 64 engages a hook 68 of the release hook 16. The second spring member 64 thus biases the release hook 16 about the secondary pivot axis 62 in a direction toward its locked position (a counter-clockwise direction in FIGS. 2 and 6) wherein the primary pivot pin 40 engages the upper end of the slot 60 so that the release hook 16 can be carried with the release handle 14. Preferably, a redundant feature is included that mechanically returns the release hook 16 to its locked or closed position when the primary hood latch assembly is latched. This redundant feature acts as a safety feature to ensure that the release hook 16 will always close to and be ready to engage and latch with the secondary striker 22.

Figure 6:
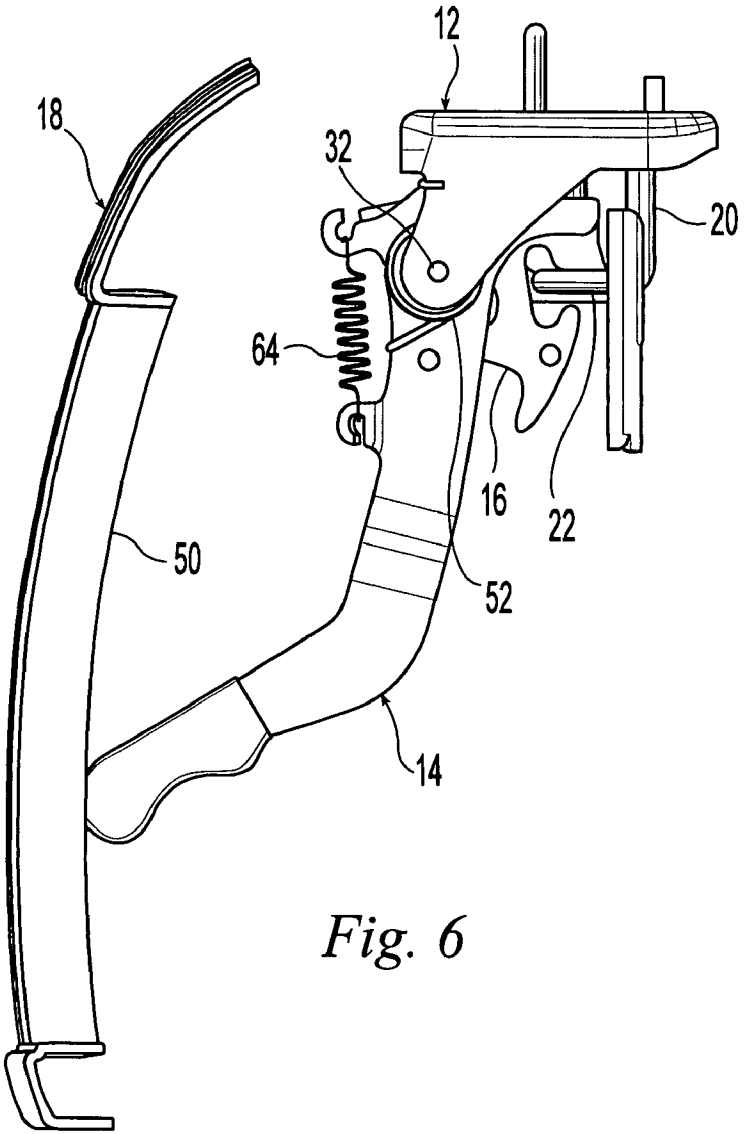
FIG. 6 is a left side elevational view of the secondary latch assembly of FIGS. 1 to 5, wherein the secondary latch assembly is in a primary latch locked position.

Referring to FIGS. 6 to 11, operation of the secondary latch assembly 10 will be described in connection with the opening of the hood 18 of an automobile having a primary hood latch. As shown in FIG. 6, when the hood 16 is in a fully closed position and the primary striker 20 latched by the primary hood latch assembly, the hood 18 cannot be raised and the release handle 14 in its closed or locked position within the hood 18 and is held in its locked position by the first spring member 52. The release hook 16 is in its locked position and is held in its locked position by the second spring member 64.

Figure 7:
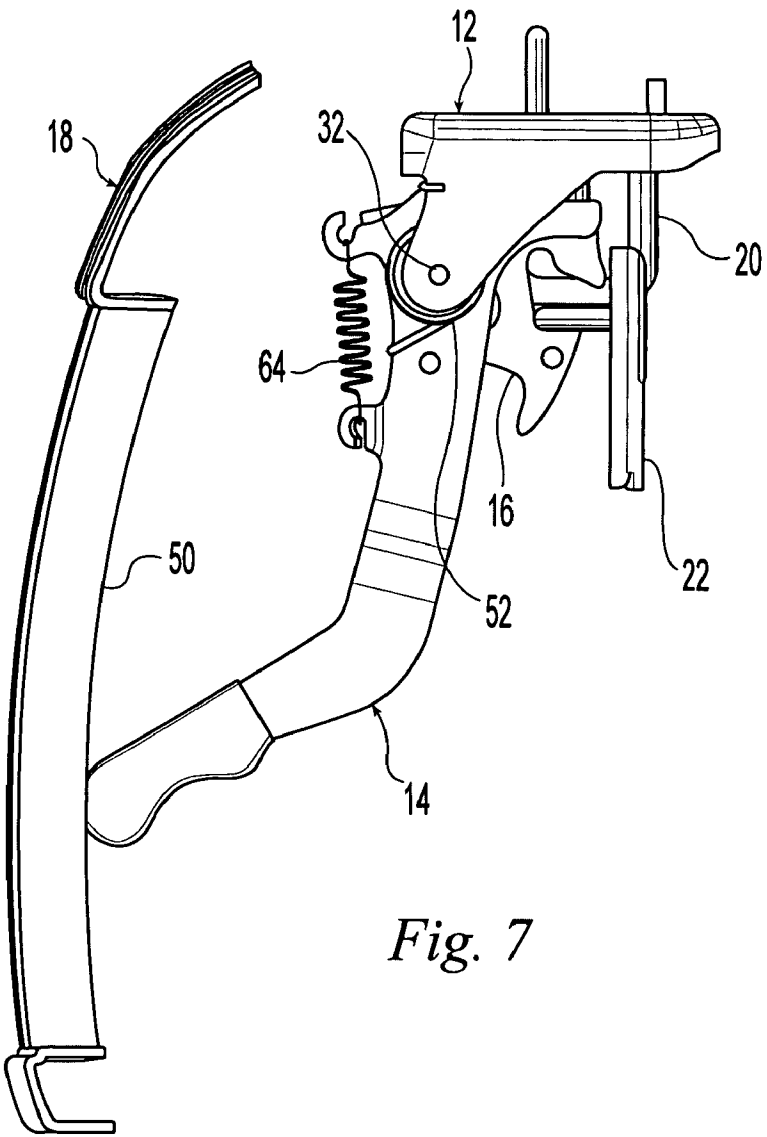
FIG. 7 is a left side elevational view similar to FIG. 6 but wherein the primary lock has been unlocked an a hook of the secondary latch assembly has first engaged a secondary striker.
Figure 8:
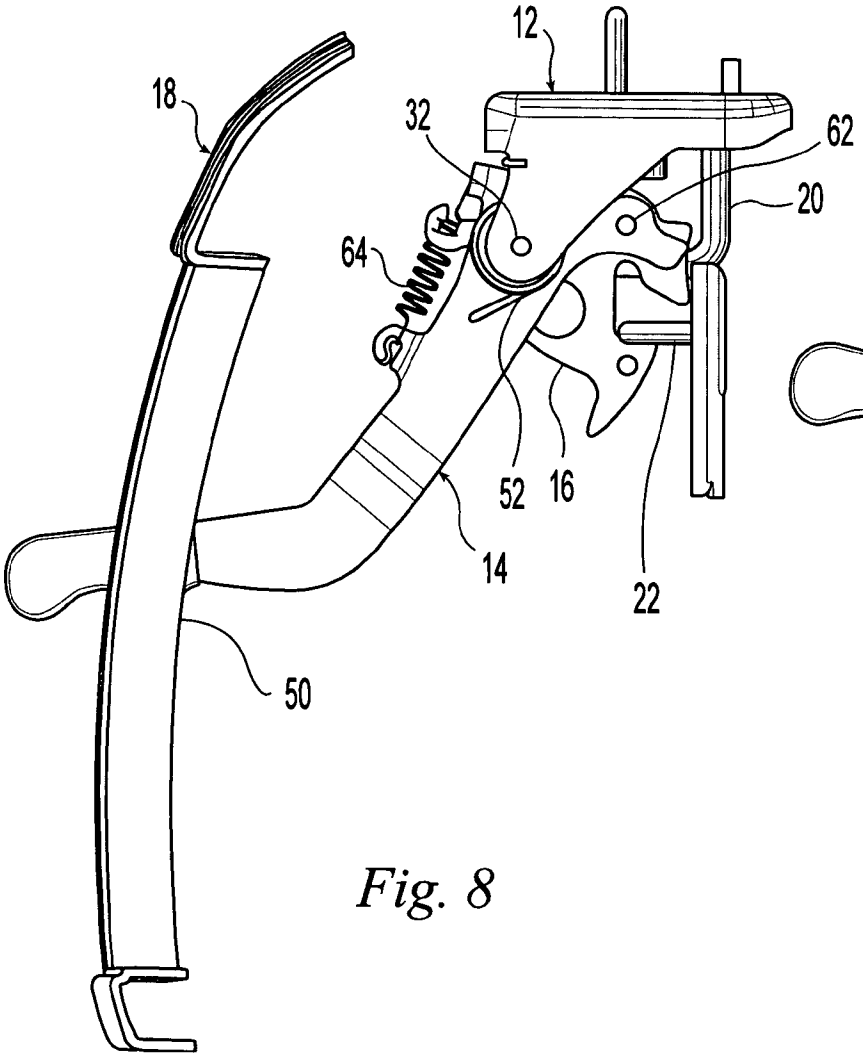
FIG. 8 is a left side elevational view similar to FIG. 7 but wherein the hook has rotated to present a release handle of the secondary latch assembly.

As shown in FIG. 7, when the primary hood latch has released the primary striker 20, the hood 18 rises to a point where the release hook 16 engages the secondary striker 22 and catches the secondary striker 22. As shown in FIG 8, the release hook 16 pivots about the primary pivot axis 32 as the hood 18 is lifted and the release hook 16 catches the secondary striker 22. The release hook 16 is maintained in its locked position by the secondary spring member 64. The rotation of the release hook 16 causes the release handle 14 to rotate to its presented position outside the grille 50 against the bias of the first spring member 52. When the hood 18 has risen to a point where the release hook 16 has engaged the secondary striker 22, the secondary latch assembly 10 limits any further upward movement of the hood 18 toward its fully opened position. In this position, the release handle 14 is presented to a user and is visible from the outside of the hood enclosure.

As shown in FIG. 9, an operator can manually raise the release handle 14 to pivot the release handle 14 about the primary pivot axis 32 and move the release handle 14 to its release position against the bias of the first spring member 52. When lifting the release handle 14, the release handle 14 pulls the release hook 16 away from the secondary striker 22 to release the hood 18 from the secondary latch assembly 10. In this position, the hood 18 is free to be moved to its fully opened position.

Figure 11:
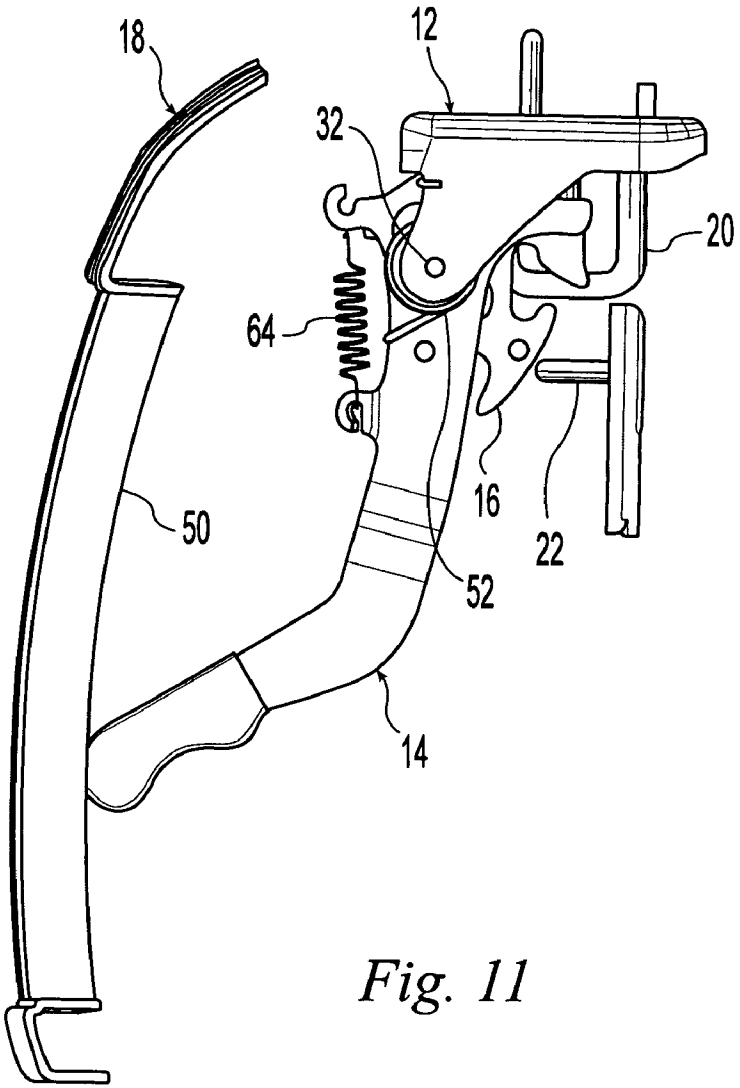
FIG. 11 is a left side elevational view similar to FIG. 10 but wherein the hook is being resiliently moved about the secondary striker (and back to its locked position of FIG. 6) as the hood is lowered while the release handle remains in its lock position.
Figure 10:
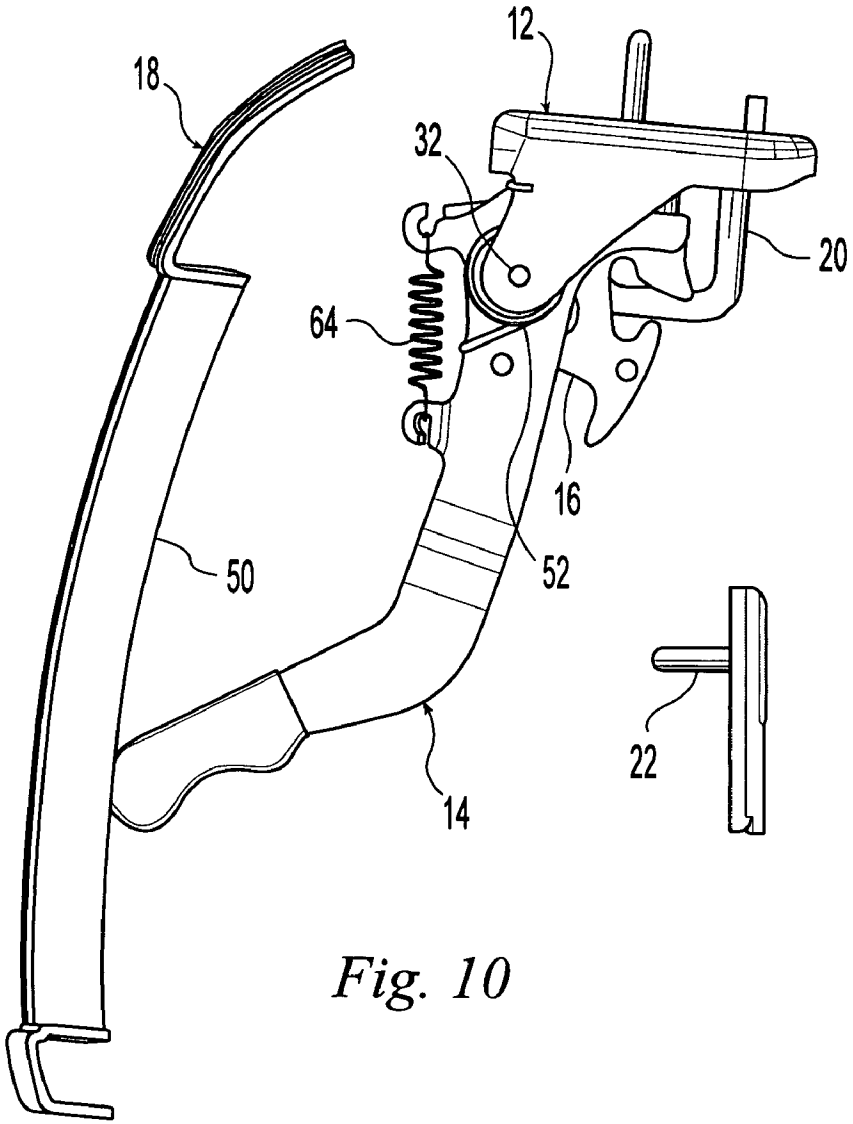
FIG. 10 is a left side elevational view similar to FIG. 9 but wherein the hook and the release handle have automatically returned to their lock position as the operator releases the handle and raises the hood.

As shown in FIG. 10, once the operator releases the release handle 14, the release handle 14 automatically returns to its closed or locked position due to the bias of the first spring member 52. The release hook 16 also automatically returns to its locked position due to the bias of the second spring member 64. As shown in FIG. 11, when the hood 18 is lowered, the release hook 16 engages the secondary striker 22 and pivots, against the bias of the secondary spring member 64, about the secondary pivot axis 62. The release hook is sized and shaped to be cammed by the secondary striker 22 in this manner. Once the release hook 16 is past the secondary striker 22, the second spring member 64 resiliently returns release hook 16 to its locked position. With the hood 18 fully closed and the primary latch assembly secured, the secondary latch assembly 10 is once again as shown in FIG. 6.

It is apparent from the above detailed description of preferred embodiments of the present invention, that the secondary latch assembly provides a self-presenting release handle that automatically returns to its closed locked position upon release by the operator and remains in its closed or locked position while the hood is closed. Because the release handle does not move during hood slam, accelerated moments about the pivot point are eliminated that could otherwise cause fatigue of metal components. Also, excited side lash at the end of the handle is eliminated. Furthermore, the handle does not remain exposed where it can be damaged.

From the foregoing disclosure and detailed description of certain preferred embodiments, it is also apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A self-presenting latch assembly comprising:

a hood movable between a fully closed position and a fully open position;

a striker located in a fixed position;

a mounting bracket secured to the hood;

a release hook supported by the mounting bracket;

a release handle supported by the mounting bracket and operably connected to the release hook;

wherein the release handle is pivotable relative to the mounting bracket between a first position wherein the hood is in the fully closed position and a grasping portion of the release handle is out of view, a second position wherein the hood is in a partially open position between the fully open position and the fully closed position and the grasping portion is presented in view and the release hook is engaging the striker to retain the hood in the partially open position, and a third position wherein the release handle has been manually rotated from its second position and the release hook is released from the striker so that the hood can be moved from the partially open position to the fully open position;

a first spring member biasing the release handle towards the first position;

wherein the release hook is pivotable relative to the release handle between a locked position wherein the release hook is lockingly engageable with the striker and pivotable with the release lever as the hood is moved from the fully closed position to the partially open position and as the release lever is manually pivoted from the second position to the third position and a released position wherein the release hook is out of locking engagement with the striker while the hood is moved from the fully open position to the fully closed position and the release handle remains in the first position;

wherein a primary pivot pin pivotably connects the release handle to the mounting bracket and a secondary pivot pin pivotably connects the release hook to the release handle;

wherein the release hook engages the striker and pivots about the primary pivot pin along with the release handle so that the release handle is pivoted from the first position to the second position against the bias of the first spring member and the release hook catches the striker to retain the hood in the partially open position when the hood is raised from the fully closed position to the partially open position with a force adequate to overcome the bias of the first spring member;

wherein the release handle can be manually pivoted about the primary pivot pin along with the release hook so that the release handle is pivoted from the second position to the third position against the bias of the first spring member and the release hook is released from the striker so that the hood can be moved from the partially open position to the fully open position when the release handle is manually pivoted toward the third position with a force adequate to overcome the bias of the first spring member; and wherein the release handle automatically returns to the first position from the third position due to the bias of the first spring member when the release handle is manually released and the release hook is released from the striker.

2. The latch assembly according to claim 1, further comprising a second spring member biasing the release hook toward the locked position.

3. The latch assembly according to claim 2, wherein the second spring member is a coil tension spring.

4. The latch assembly according to claim 1, wherein the first spring member is a torsion spring.

5. The latch assembly according to claim 1, wherein the release hook is carried by the release handle.

6. The latch assembly according to claim 1, wherein the primary pivot pin extends through a slot in the release hook.

7. The latch assembly according to claim 6, wherein the primary pivot pin engages an end of the slot so that pivoting motion of the release handle from the second position to the third position pulls the release hook out of engagement with the striker.

8. The latch assembly according to claim 1, wherein the release hook is positioned between the release handle and a cover plate secured to the release handle for movement therewith.

9. A self-presenting latch assembly comprising:

a hood movable between a fully closed position and a fully open position;

a striker located in a fixed position;

a mounting bracket secured to the hood;

a release hook supported by the mounting bracket;

a release handle supported by the mounting bracket and operably connected to the release hook;

wherein the release handle is pivotable relative to the mounting bracket between a first position wherein the hood is in the fully closed position and a grasping portion of the release handle is out of view, a second position wherein the hood is in a partially open position between the fully open position and the fully closed position and the grasping portion is presented in view and the release hook is engaging the striker to retain the hood in the partially open position, and a third position wherein the release handle has been manually rotated from its second position and the release hook is released from the striker so that the hood can be moved from the partially open position to the fully open position;

a first spring member biasing the release handle towards the first position;

wherein the release hook is pivotable relative to the release handle between a locked position wherein the release hook is lockingly engageable with the striker and pivotable with the release lever as the hood is moved from the fully closed position to the partially open position and as the release lever is manually pivoted from the second position to the third position and a released position wherein the release hook is out of locking engagement with the striker while the hood is moved from the fully open position to the fully closed position and the release handle remains in the first position;

wherein the first spring member pivots the release handle from the third position to the first position when an operator releases the handle and the release hook is out of engagement with the striker; and wherein a primary pivot pin pivotably connects the release handle to the mounting bracket and a secondary pivot pin pivotably connects the release hook to the release handle;

wherein the release hook engages the striker and pivots about the primary pivot pin along with the release handle so that the release handle is pivoted from the first position to the second position against the bias of the first spring member and the release hook catches the striker to retain the hood in the partially open position when the hood is raised from the fully closed position to the partially open position with a force adequate to overcome the bias of the first spring member; and wherein the release handle can be manually pivoted about the primary pivot pin along with the release hook so that the release handle is pivoted from the second position to the third position against the bias of the first spring member and the release hook is released from the striker so that the hood can be moved from the partially open position to the fully open position when the release handle is manually pivoted toward the third position with a force adequate to overcome the bias of the first spring member.

10. The latch assembly according to claim 9, further comprising a second spring member biasing the release hook toward the locked position.

11. The latch assembly according to claim 10, wherein the second spring member is a coil tension spring.

12. The latch assembly according to claim 9, wherein the first spring member is a torsion spring.

13. The latch assembly according to claim 9, wherein the release hook is carried by the release handle.

14. The latch assembly according to claim 9, wherein the primary pivot pin extends through a slot in the release hook.

15. The latch assembly according to claim 14, wherein the primary pivot pin engages an end of the slot so that pivoting motion of the release handle from the second position to the third position pulls the release hook out of engagement with the striker.

16. The latch assembly according to claim 9, wherein the release hook is positioned between the release handle and a cover plate secured to the release handle for movement therewith.

17. A self-presenting latch assembly comprising:

a hood movable between a fully closed position and a fully open position;

a striker located in a fixed position;

a mounting bracket secured to the hood;

a release hook supported by the mounting bracket;

a release handle supported by the mounting bracket and operably connected to the release hook;

wherein the release handle is pivotable relative to the mounting bracket between a first position wherein the hood is in the fully closed position and a grasping portion of the release handle is out of view, a second position wherein the hood is in a partially open position between the fully open position and the fully closed position and the grasping portion is presented in view and the release hook is engaging the striker to retain the hood in the partially open position, and a third position wherein the release handle has been manually rotated from its second position and the release hook is released from the striker so that the hood can be moved from the partially open position to the fully open position;

a first spring member biasing the release handle towards the first position;

wherein the release hook is pivotable relative to the release handle between a locked position wherein the release hook is lockingly engageable with the striker and a released position wherein the release hook is out of locking engagement with the striker while the release handle remains in the first position;

wherein the release hook is pivotable relative to the release handle between a locked position wherein the release hook is lockingly engageable with the striker and pivotable with the release lever as the hood is moved from the fully closed position to the partially open position and as the release lever is manually pivoted from the second position to the third position and a released position wherein the release hook is out of locking engagement with the striker while the hood is moved from the fully open position to the fully closed position and the release handle remains in the first position;

a second spring member biasing the release hook toward the locked position;

wherein the first spring member automatically pivots the release handle from the third position to the first position when an operator releases the handle and the release hook is out of engagement with the striker;

wherein a primary pivot pin pivotably connects the release handle to the mounting bracket and a secondary pivot pin pivotably connects the release hook to the release handle;

wherein the release hook engages the striker and pivots about the primary pivot pin along with the release handle so that the release handle is pivoted from the first position to the second position against the bias of the first spring member and the release hook catches the striker to retain the hood in the partially open position when the hood is raised from the fully closed position to the partially open position with a force adequate to overcome the bias of the first spring member; and wherein the release handle can be manually pivoted about the primary pivot pin along with the release hook so that the release handle is pivoted from the second position to the third position against the bias of the first spring member and the release hook is released from the striker so that the hood can be moved from the partially open position to the fully open position when the release handle is manually pivoted toward the third position with a force adequate to overcome the bias of the first spring member.

* * * * *